US007495381B2

(12) United States Patent
Chi et al.

(10) Patent No.: US 7,495,381 B2
(45) Date of Patent: Feb. 24, 2009

(54) GRID ELECTRODE FOR ELECTRON EMISSION DEVICE, AND ELECTRON EMISSION DEVICE INCLUDING THE SAME

(75) Inventors: Eung-Joon Chi, Suwon-si (KR); Sang-Ho Jeon, Suwon-si (KR); Byong-Gon Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 335 days.

(21) Appl. No.: 11/066,582

(22) Filed: Feb. 25, 2005

(65) Prior Publication Data

US 2005/0184648 A1 Aug. 25, 2005

(30) Foreign Application Priority Data

Feb. 25, 2004 (KR) ..... 10-2004-0012633

(51) Int. Cl.
*H01J 1/62* (2006.01)

(52) U.S. Cl. ..... 313/497

(58) Field of Classification Search ..... 313/497
See application file for complete search history.

(56) References Cited

U.S. PATENT DOCUMENTS 5,653,619 A * 8/1997 Cloud et al. ..... 445/24
6,551,720 B2 * 4/2003 Sreeram et al. ..... 428/469
7,105,200 B2 * 9/2006 Sakamoto et al. ..... 427/203
7,190,107 B2 * 3/2007 Sasaki et al. ..... 313/311
2004/0056586 A1 * 3/2004 Sasaki et al. ..... 313/495
2004/0138042 A1 * 7/2004 Shimosaka et al. ..... 501/32
2004/0197220 A1 * 10/2004 Katsuragi et al. ..... 420/97
2006/0246295 A1 * 11/2006 Sakamoto et al. ..... 428/411.1

FOREIGN PATENT DOCUMENTS

JP WO 03032334 A1 * 4/2003
JP 2004052083 A * 2/2004

OTHER PUBLICATIONS

Machine translation of Sakamoto.*

* cited by examiner

*Primary Examiner*—Peter Macchiarolo
(74) *Attorney, Agent, or Firm*—Christie, Parker & Hale, LLP

(57) ABSTRACT

The present invention relates to an electron emission device, and more particularly, to an electron emission device comprising a grid electrode having a thermal expansion coefficient ranging from about 80 to about 120% of the thermal expansion coefficient of the first or second substrate of the electron emission device. The grid electrode is fixed in position by minimizing misalignment caused by a difference in thermal expansion coefficients between the grid electrode and the first and second substrates of the electron emission device. The grid electrode also minimizes generation of arc discharge. However, even when arc discharge is generated, the grid electrode prevents damage to the cathode electrodes and gate electrodes from that arc discharge. According to the present invention, an electron emission device with increased brightness and resolution is easily realized by applying increased voltage to the anode electrode.

9 Claims, 6 Drawing Sheets

GRID ELECTRODE FOR ELECTRON EMISSION DEVICE, AND ELECTRON EMISSION DEVICE INCLUDING THE SAME

CROSS REFERENCE TO RELATED APPLICATION

This application claims priority to and the benefit of Korean Patent Application No. 10-2004-0012633 filed on Feb. 25, 2004 in the Korean Intellectual Property Office, the entire content of which is incorporated herein by reference.

FIELD OF THE INVENTION

The present invention relates to an electron emission device, and more particularly, to an electron emission device equipped with a metal grid electrode that focuses electrons emitted from an electron emitting region.

BACKGROUND OF THE INVENTION

An electron emission device (EED) generally comprises a display apparatus from which an arbitrary image is realized when electrons emitted from an electron emitting region of a cathode electrode irradiate. The electrons irradiate through the tunneling effect of quantum mechanics, by colliding with a phosphor layer formed on an anode. A triode consisting of a cathode electrode, a gate electrode, and an anode electrode is a widely used structure for an EED.

A commonly used triode consists of a vacuum container comprising a rear substrate comprising a cathode electrode and a gate electrode and a front substrate comprising an anode electrode. The vacuum container is put together using a sealant, such as a frit. The vacuum container includes several spacers creating a fixed gap between the rear and front substrates to keep the rear substrate away from the front substrate.

An arc discharge is generated in the vacuum container by the electron emission device. It can be inferred that the arc discharge is generated by the simultaneous ionization of a great deal of gas by outgassing, which occurs in the vacuum container. Generally, the arc discharge generated becomes more severe as the anode voltage increases. Due to this arc discharge, the gate electrode can be easily damaged because the anode electrode can be electrically shorted with the gate electrode.

To resolve this problem, an electron emission device has been proposed in which a metal grid electrode is equipped between the rear substrate and the front substrate. The grid electrode can protect the electrodes equipped on the rear substrate from damage due to generation of the arc discharge, and improves the capability of focusing the emitted electrons.

However, when the thermal expansion coefficient of the metal grid electrode differs remarkably from the thermal expansion coefficient of heat-reinforced glass used for the front and rear substrate of a flat panel display, several problems occur during the sealing and exhaust processes of the electron emission device. One such problem is the limited availability of high temperature processes. Another problem is that the panel can be damaged during the exhaust process when the grid electrode and underplate are misaligned. Moreover, electrons emitted from the electron emitting region may collide with the phosphor layer of a surrounding territory instead of the selected territory due to the misalignment of the grid electrode, and the color purity can depreciate.

To solve these problems, a design has been introduced which compensates for the misalignment of the grid electrode generated during the heat treatment process. However, this design uses a troublesome process and has certain limitations in quality control.

SUMMARY OF THE INVENTION

In one embodiment of the present invention, an electron emission device is provided that is capable of preventing misalignment due to a difference of thermal expansion coefficients between the grid electrode and front and rear substrates by providing a metallic grid electrode having a thermal expansion coefficient similar to those of the first and second substrates.

In a first embodiment, the electron emission device (EED) comprises a first substrate and a second substrate constituting a vacuum container, positioned opposite each other with a predetermined gap therebetween; cathode electrodes and gate electrodes provided in an insulating state on an insulating layer on the first substrate; electron emitting regions comprising an electron emitting material, formed on the cathode electrode; at least one anode electrode and phosphor layers of a red, a green, and a blue color provided on the second substrate; and a grid electrode installed in the vacuum container, and equipped with holes for passing of electrons emitted from the electron emitting region, wherein a thermal expansion coefficient of the grid electrode is in the range of 80 to 120% of the thermal expansion coefficient of the first and second substrates.

In a second embodiment, the electron emission device (EED) comprises a first substrate and a second substrate constituting a vacuum container, positioned opposite each other with a predetermined gap therebetween; cathode electrodes and gate electrodes provided in an insulating state on an insulating layer on the first substrate; electron emitting regions comprising an electron emitting material, formed on the cathode electrode; at least one anode electrode and phosphor layers of a red, a green, and a blue color provided on the second substrate; and a grid electrode installed in the vacuum container, and equipped with holes for passing of electrons emitted from the electron emitting region, wherein the grid electrode comprises a nickel-iron alloy.

BRIEF DESCRIPTION OF THE DRAWINGS

The above and other advantages of the present invention will be better understood by reference to the following detailed description when considered in conjunction with the accompanying drawings wherein.

DETAILED DESCRIPTION

In the first embodiment, the electron emission device (EED) comprises a first substrate and a second substrate constituting a vacuum container, positioned opposite each other with a predetermined gap therebetween; cathode electrodes and gate electrodes provided in an insulating state on an insulating layer on the first substrate; electron emitting regions comprising an electron emitting material, formed on the cathode electrode; at least one anode electrode and phosphor layers of a red, a green, and a blue color provided on the second substrate; and a grid electrode installed in the vacuum container, and equipped with holes for passing of electrons emitted from the electron emitting region, wherein a thermal expansion coefficient of the grid electrode is in the range of 80 to 120% of the thermal expansion coefficient of the first substrate and the second substrate.

In the second embodiment, the electron emission device (EED) comprises a first substrate and a second substrate constituting a vacuum container, positioned opposite each other with a predetermined gap therebetween; cathode electrodes and gate electrodes provided in an insulating state on the other side of an insulating layer on the first substrate; electron emitting regions comprising an electron emitting material, formed on the cathode electrode; at least one anode electrode and phosphor layers of a red, a green, and a blue color provided on the second substrate; and a grid electrode installed in the vacuum container, and equipped with holes for passing of electrons emitted from the electron emitting region, wherein the grid electrode comprises a nickel-iron alloy.

The present invention is described in more detail with reference to the accompanying drawings. However, the present invention is not limited by the structure of the drawings. Rather, the drawings illustrate examples of the electron emission device of the present invention.

As used herein, the "first substrate" refers to a front substrate comprising the phosphor layers, and the "second substrate" refers to a rear substrate comprising the electron emitting regions.

Figure 1:
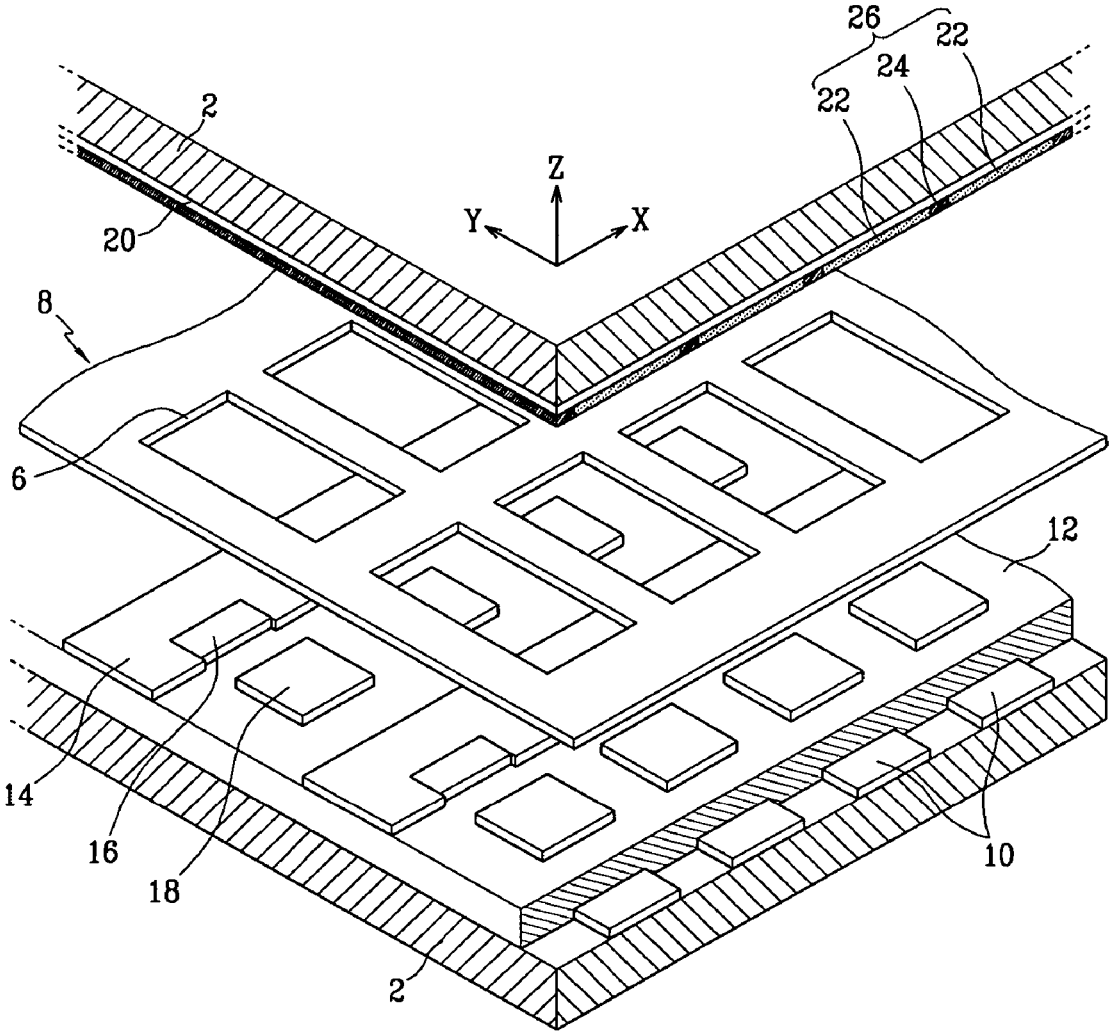
FIG. 1 is a partially exploded perspective view of an electron emission device according to one embodiment of the present invention.
Figure 2:
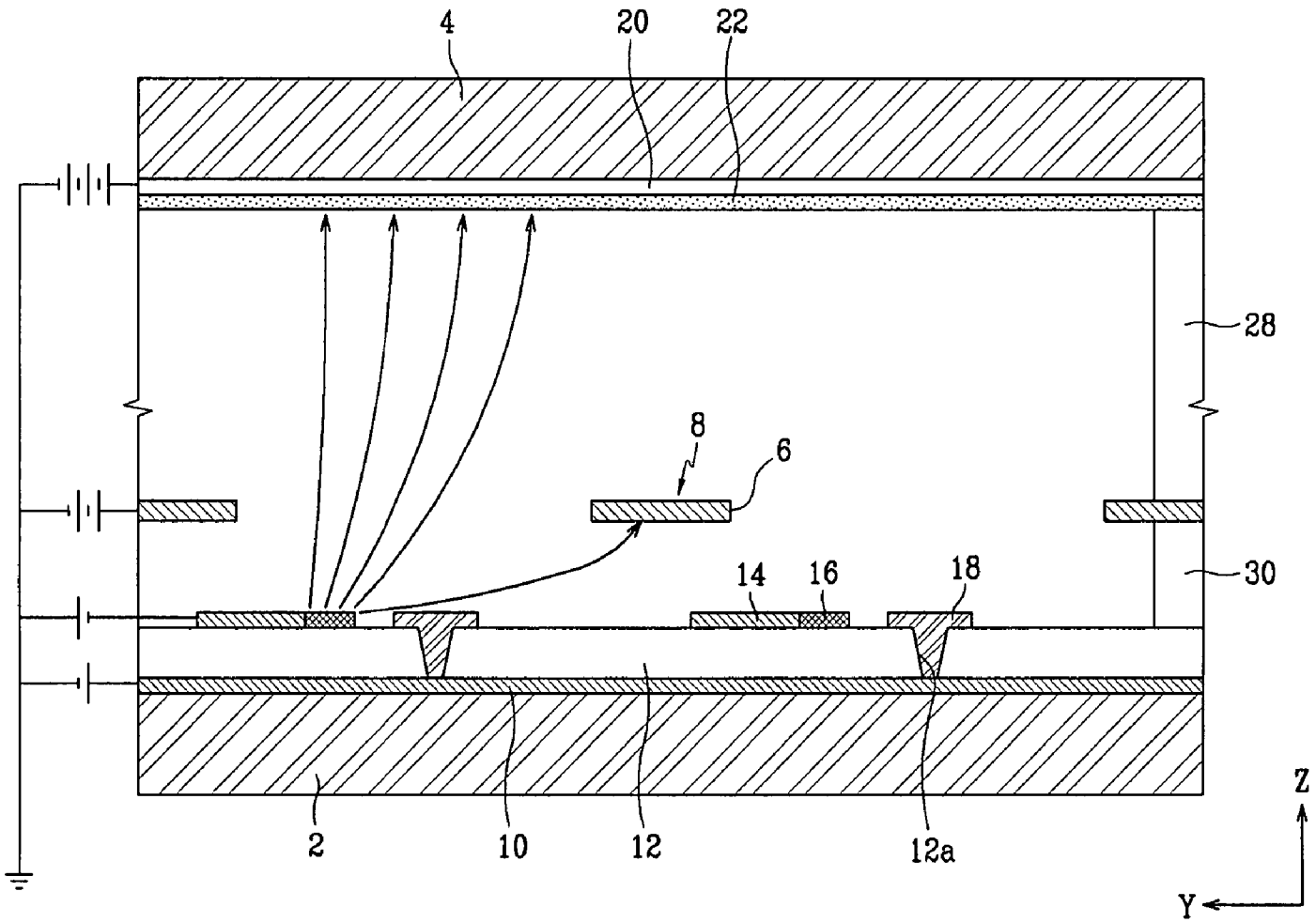
FIG. 2 is a partial cross-sectional view of the electron emission device of FIG. 1.

FIG. 1 is a partially exploded perspective view of an electron emission device comprising a grid electrode according to one embodiment of the present invention. FIG. 2 is a partial cross-sectional view of the electron emission device shown in FIG. 1.

With reference to FIGS. 1 and 2, the electron emission device comprises a first substrate 2 and a second substrate 4 which constitute a vacuum container. The first substrate 2 and the second substrate 4 are positioned facing each other and separated from each other by a predetermined distance. A grid electrode 8 is positioned between the first substrate 2 and the second substrate 4. The grid electrode 8 comprises several openings 6 to allow passage of an electron beam. An electron forming region for emitting electrons is provided on the first substrate 2. An image realizing region is provided on the second substrate. A visual light is irradiated from the image realizing region by electrons emitted from the first substrate 2 to the second substrate 4.

More particularly, the gate electrodes 10 are positioned on the first substrate 2 in a striped pattern, and each gate electrode 10 extends along the Y direction. An insulating layer 12 is positioned over the gate electrodes 12 on the side of the first substrate 2 facing the second substrate 4. The cathode electrodes 14 are positioned on the insulating layer 12 in a striped pattern, and each cathode electrode 14 extends along the X direction, perpendicular to the gate electrodes 10. An electron emitting region 16 for an electron emission source is positioned on the edge of the cathode electrode 14 at each point where the cathode electrodes 14 intersect the gate electrodes 10.

If desired, a counter electrode 18 can be positioned on the first substrate 2. The counter electrode 18 is electrically connected to the gate electrode 10 by contact through a hole 12*a* formed in the insulating layer 12. The counter electrode 18 is positioned between the cathode electrodes 14 and separated from the electron emitting region 16 by a predetermined distance. The counter electrode 18 provides a stronger electric field in the area surrounding the electron emitting region 16, such that electrons are favorably emitted from the electron emitting region 16.

Additionally, an anode electrode 20 is formed on the side of the second substrate 4 facing the first substrate 2. Red, green and blue phosphor layers 22 are provided on the anode electrode 20. Phosphor screens 26 consisting of black color layers 24, are formed on the anode electrode 20 and positioned between the phosphor layers 22. The anode electrode 20 comprises a transparent electrode such as indium tin oxide (ITO). As shown in FIGS. 1 and 2, the anode electrode 20 comprises one electrode formed on the entire surface of the second substrate 4. Alternatively, the anode electrode 20 may comprise several electrodes formed on the substrate in a pattern corresponding with the pattern of the phosphor layers 22. If desired, a metal layer (not shown) can be positioned on the surface of the phosphor screens 26 to improve brightness by a metal back effect. In this embodiment, the transparent electrode can be omitted and the metal layer used as the anode electrode.

Moreover, a grid electrode 8 for focusing the electron beam is positioned between the first substrate 2 and the second substrate 4, but is positioned closer to the first substrate 2. The grid electrode 8 comprises a metal plate having several openings 6 to allow passage of the electron beam. The grid electrode 8 is positioned in the vacuum container by upper spacers 28 situated between the second substrate 4 and the grid electrode 8 and lower spacers 30 situated between the first substrate 2 and the grid electrode 8. The spacers 28 and 30 separate the grid electrode 8 from first and second substrates by a predetermined, constant distance.

Figure 3:
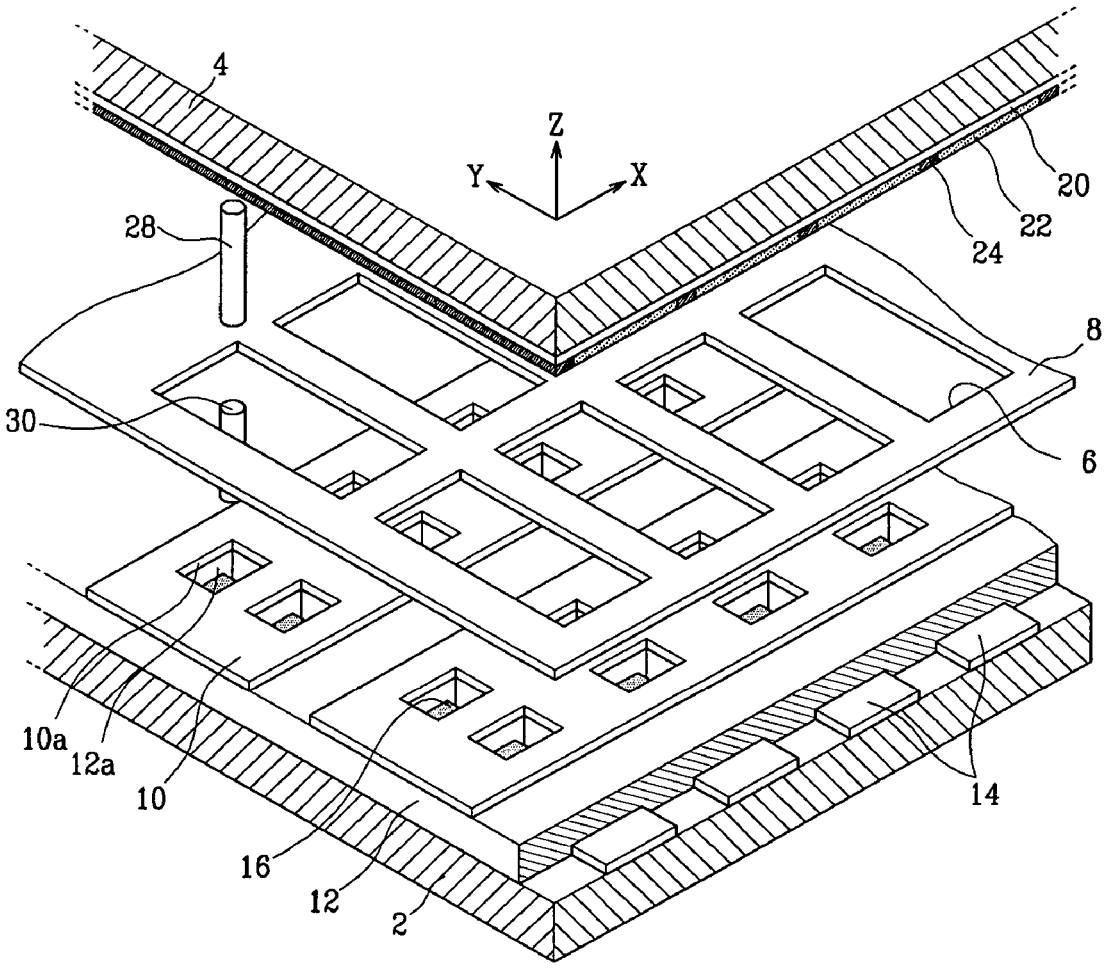
FIG. 3 is a partially exploded perspective view of an electron emission device comprising a grid electrode according to another embodiment of the present invention.
Figure 4:
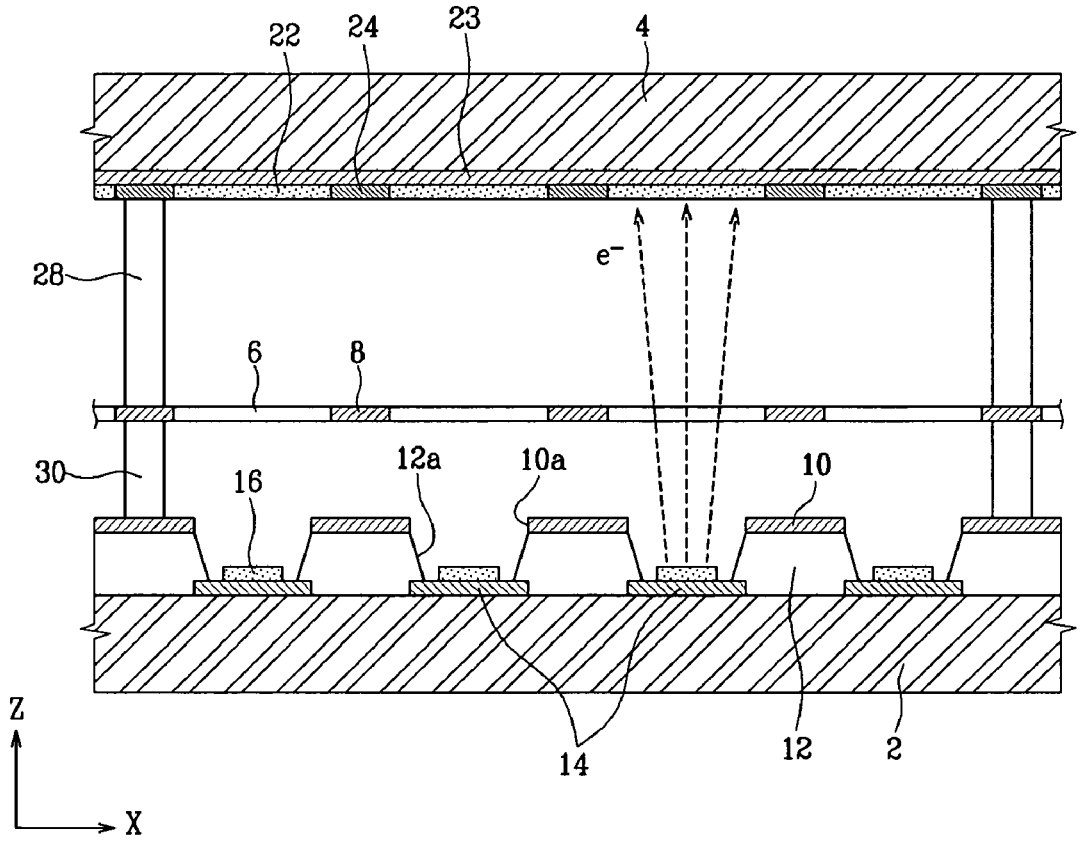
FIG. 4 is a partial cross-sectional view of the electron emission device shown in FIG. 3.

FIG. 3 is a partially exploded perspective view of an electron emission device comprising a grid electrode according to another embodiment of the present invention. FIG. 4 is a partial cross-sectional view of the electron emission device shown in FIG. 3.

With reference to FIGS. 3 and 4, the electron emission device (EED) includes a first substrate 2, of predetermined dimensions, and a second substrate 4, of predetermined dimensions. The first substrate 2 is provided substantially in parallel with the second substrate 4 with a predetermined gap therebetween. The first substrate 2 and the second substrate 4 are connected in this configuration to define an exterior of the EED and to form a vacuum assembly.

An emission structure to enable the emission of electrons by an electric field is formed on the second substrate 4, and an illumination structure to enable the realization of predetermined images by interaction with electrons is formed on the first substrate 2.

In more detail, for the emission structure, cathode electrodes 14 are formed in a stripe pattern, and an insulating layer 12 is formed over an entire surface of the second substrate 4 covering the cathode electrodes 14. Further, gate electrodes 10 are formed in a stripe pattern on the insulating layer 12. Holes 10*a* and 12*a* are formed in the gate electrodes 10 and the insulating layer 12, and electron emitting regions 16 are formed on the cathode electrodes 14 in the same areas exposed through the holes 10*a* and 12*a*.

With respect to the illumination structure for realizing predetermined images, anode electrodes 20 are formed on a surface of the first substrate 2 opposing the second substrate 4. Also, phosphor layers 22 and black color layers 24 are formed on the anode electrodes 20. The phosphor layers 22 are illuminated by electrons emitted from the electron sources 16 of the second substrate 4.

With this structure, if electrons are emitted from the electron emitting regions 16 by the voltage difference between the cathode electrodes 14 and the gate electrodes 10, the electrons are attracted by a high voltage applied to the anode electrodes 20 to strike the phosphor layers 22 and excite the same.

A grid electrode 8 is mounted between the first substrate 2 and the second substrate 4 to prevent arc discharge between these elements and to aid in focusing the emitted electrons. Preferably, the grid electrode 8 includes a plurality of openings 6, each opening 6 corresponding to one electron emitting region 16. The grid electrode 8 is positioned in the vacuum container by upper spacers 28 situated between the second substrate 4 and the grid electrode 8 and lower spacers 30 situated between the first substrate 2 and the grid electrode 8. The spacers 28 and 30 separate the grid electrode 8 from the first and second substrates by a predetermined, constant distance.

In the said EEDs, the electron emitting regions 16 comprise a carbon-based material. Preferably, the carbon-based material is selected from the group consisting of carbon nanotubes, graphite, diamond, diamond-like carbon, fullerene (C60), and mixtures thereof.

Preferably, the first and second substrates comprise glass substrates having thermal expansion coefficients ranging from about $1.0\times10^{-6}$ to about $10.0\times10^{-6}/°$ C. More preferably, the first and second substrates comprise heat-reinforced glass substrates having thermal expansion coefficients ranging from about $1.0\times10^{-6}$ to about $10.0\times10^{-6}/°$ C.

The thermal expansion coefficient of the grid electrode ranges from about 80 to about 120% of the thermal expansion coefficient of the first and second substrates 2 and 4, preferably about 90 to about 110%, and more preferably about 95 to about 105%. When the thermal expansion coefficient of the grid electrode is less than about 80% or more than about 120% of the thermal expansion coefficient of the glass substrate, the possibility of a misalignment increases. Therefore, the difference in thermal expansion coefficients between the grid electrode and the glass substrates is preferably as small as possible.

The thermal expansion coefficient of the grid electrode is controllable by controlling the nickel content of a nickel-iron alloy. For example, when the first and second substrates 2 and 4, respectively, comprise heat-reinforced glass having a thermal expansion coefficient ranging from about $1.0\times10^{-6}$ to about $10.0\times10^{-6}/°$ C., a grid electrode comprising a nickel-iron alloy with a nickel content ranging from about 42 to about 52 wt % can be used. Preferably, the nickel content ranges from about 45 to about 50 wt. %, more preferably about 47 to about 49 wt. %.

A 36 nickel-iron alloy, i.e. an alloy with a nickel content of 36 wt. %, has previously been used as the grid electrode or the shadow mask for a cathode-ray tube (CRT). However, such an alloy is inadequate for high temperature processes and misalignment easily occurs between the grid electrode and the lower plate because the thermal expansion coefficient of this 36 nickel-iron alloy is substantially smaller than the thermal expansion coefficient of the first and second substrates in the flat panel display. However, the nickel-iron alloy having a nickel content in the range of 42 to 52 wt %, as used in the present invention, has a thermal expansion coefficient in the desired range, substantially eliminating the misalignment problems and the problems associated with high temperature processes.

The grid electrode of the present invention mainly comprises the nickel-iron alloy. In addition, however, a metal selected from the group consisting of chromium, cobalt, or titanium, may optionally be included to impart desired physical and mechanical properties, for example etching and workability. Chromium, cobalt, or titanium are present in the nickel-iron alloy in an amount according to necessity. Preferably, however, chromium is present in an amount ranging from about 0.01 to about 10 wt. %.

In one embodiment, the thickness of the grid electrode ranges from about 0.05 to about 0.2 mm. When the thickness of the grid electrode is less than about 0.05 mm, mechanical handling of the electrode is difficult. When the thickness of the grid electrode is greater than about 0.2 mm, processing of a microscopic hole is difficult.

The electron emission device comprising a grid electrode of the present invention can be fabricated according to a top-gate form, an under-gate form, or a modified form with reference to the position of the gate electrode, and is not limited by an electron emission device of a specific structure.

Hereafter, examples of the present invention are described. The examples described below are only examples of the present invention, and the present invention is not limited by these examples.

EXAMPLE 1

Heat-reinforced glass (PD-200) having a thermal expansion coefficient (TEC) of $8.6\times10^{-6}/°$ C. was used as the first and second substrates. The grid electrode was manufactured using a nickel-iron alloy comprising 42 wt % nickel. An electron emission device was fabricated according to the structure shown in FIG. 1.

EXAMPLE 2

An electron emission device was fabricated according to the method described in Example 1, except that the grid electrode was manufactured using a nickel-iron alloy comprising 45 wt % nickel.

EXAMPLE 3

An electron emission device was fabricated according to the method described in Example 1, except that the grid electrode was manufactured by using a nickel-iron alloy comprising 47 wt % nickel.

EXAMPLE 4

An electron emission device was fabricated according to the method described in Example 1, except that the grid electrode was manufactured using a nickel-chromium-iron alloy comprising 42 wt % nickel, 6 wt % chromium and 52 wt % iron.

COMPARATIVE EXAMPLE 1

An electron emission device was fabricated according to the method described in Example 1, except that the grid electrode was manufactured using a nickel-iron alloy comprising 36 wt % nickel.

Figure 5:
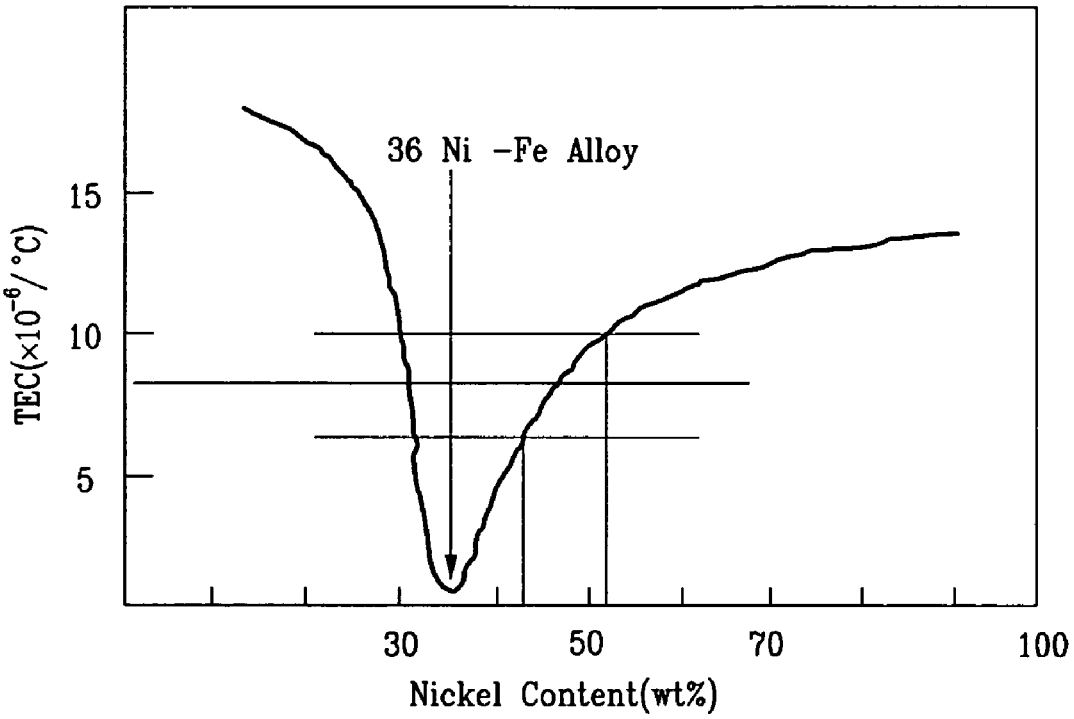
FIG. 5 is a graph showing the relationship of the thermal expansion coefficient of a metal grid electrode to the nickel content of the grid electrode.

FIG. 5 is a graph showing the relationship of the thermal expansion coefficient of a metal grid electrode to the nickel content of the grid electrode. The area enclosed in dotted lines shows a thermal expansion coefficient of heat-reinforced glass of about $8.6\times10^{-6}$/° C.

The following table lists the thermal expansion coefficients (TEC) of the grid electrodes used in Examples 1 to 4 and Comparative Example 1.

TABLE 1

| | Example 1 | Example 2 | Example 3 | Example 4 | Comparative Example1 |
|---|---|---|---|---|---|
| TEC (/° C.) | $6.9\times10^{-6}$ | $7.7\times10^{-6}$ | $8.2\times10^{-6}$ | $7.5\times10^{-6}$ | $4.0\times10^{-6}$ |

Misalignment does not occur during the sealing and exhausting processes in the electron emission devices of Examples 1 to 4, but does occur during the sealing and exhausting processes in the electron emission device of Comparative Example 1, which generates a damaged part.

Figure 6:
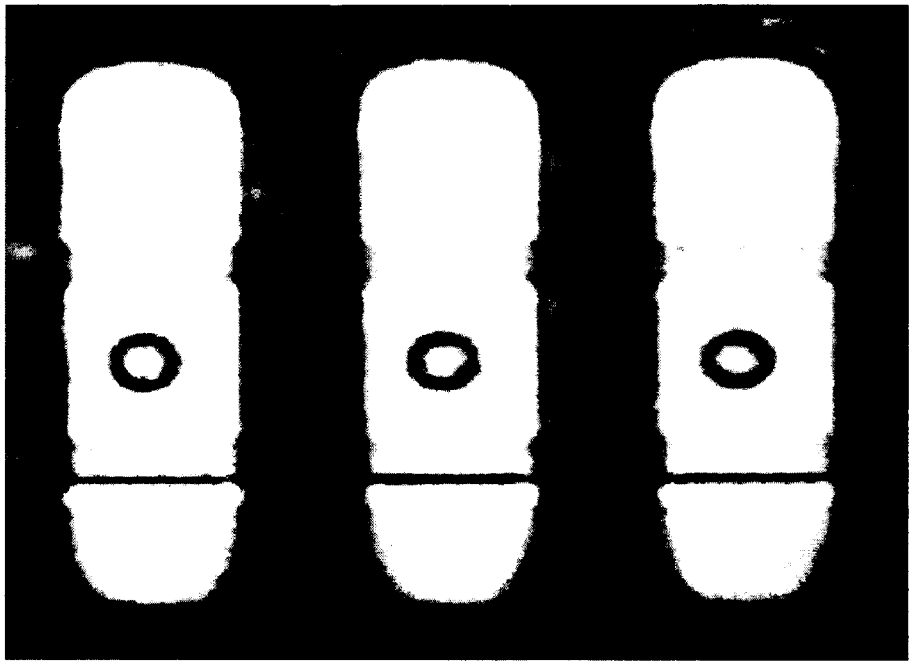
FIG. 6 is a pictorial representation of the alignment of electrodes on the first substrate of an electron emission device fabricated according to Example 3.
Figure 7:
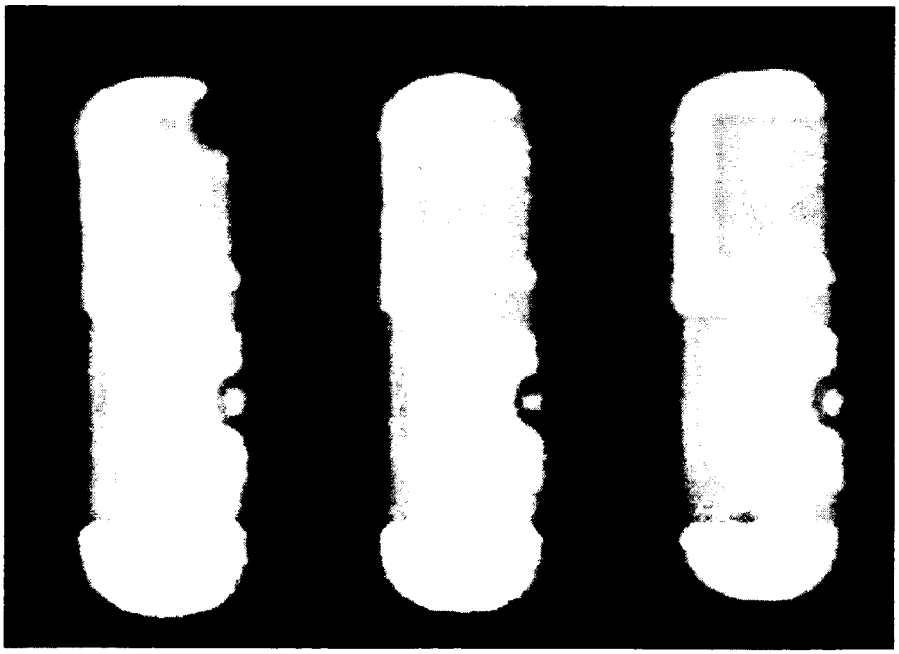
FIG. 7 is a pictorial representation of the alignment of electrodes on the first substrate of an electron emission device fabricated according to Comparative Example 1.

FIGS. 6 and 7 are microscopic pictures showing the alignment of electrodes on the first substrate of the electron emission devices of Example 3 and Comparative Example 1, respectively. As shown in FIG. 6, the cathode electrodes of the electron emission device of Example 3 can be seen through the openings in the grid electrodes, indicating exact alignment of the electrodes. On the contrary, as shown in FIG. 7, the cathode electrodes of the electron emission device of Comparative Example 1 are offset, indicating misalignment of the electrodes.

The misalignment occurs due to a difference of the thermal expansion coefficient between the grid electrode and the front or rear substrate. This misalignment can be prevented, as it is in the present invention, by adopting a metallic grid electrode having a thermal expansion coefficient similar to that of the first and second substrates. In so doing, alignment precision is improved, high temperature processes are possible, and the reliability of the device is improved.

What is claimed is:

1. An electron emission device (EED) comprising:

a first substrate and a second substrate facing each other, wherein each of the first and second substrates comprises a glass substrate having a thermal expansion coefficient ranging from about $1.0\times10^{-6}$ to about $10.0\times10^{-6}$/° C.;

at least one cathode electrode and at least one gate electrode on said first substrate, wherein the cathode electrode and gate electrode are insulated from each other by an insulating layer;

at least one electron emitting region on said at least one cathode electrode, the at least one electron emitting region comprising an electron emitting material;

at least one anode electrode and red, green and blue phosphor layers on said second substrate; and a grid electrode having holes for passing electrons emitted from said electron emitting regions, wherein a thermal expansion coefficient of said grid electrode ranges from 80 to 120% of the thermal expansion coefficient of said first substrate and second substrate, and wherein the grid electrode comprises a nickel-iron alloy having a nickel content ranging from about 45 to about 50 wt % and said grid electrode further comprises at least one metal selected from the group consisting of cobalt and titanium.

2. The electron emission device according to claim 1, wherein the thermal expansion coefficient of said grid electrode ranges from about 90 to about 110% of the thermal expansion coefficient of said first and second substrates.

3. The electron emission device according to claim 1, wherein the thermal expansion coefficient of said grid electrode ranges from about 95 to about 105% of the thermal expansion coefficient of said first and second substrates.

4. The electron emission device according to claim 1, wherein the thermal expansion coefficient of said grid electrode is controlled by a content of nickel in the electrode.

5. The electron emission device according to claim 1, wherein said grid electrode comprises a nickel-iron alloy having a nickel content ranging from about 47 to about 49 wt %.

6. The electron emission device according to claim 1, wherein said grid electrode has a thickness ranging from about 0.05 to about 0.2 mm.

7. The electron emission device according to claim 1, wherein said electron emitting region comprises at least one carbon-based material selected from the group consisting of carbon nanotubes (CNT), graphite, diamond, diamond like carbon (DLC), fullerene (C60), and mixtures thereof.

8. An electron emission device (EED) comprising:

a first substrate and a second substrate facing each other, wherein each of the first and second substrates comprises a glass substrate having a thermal expansion coefficient ranging from about $1.0\times10^{-6}$ to about $10.0\times10^{-6}$/° C.;

at least one cathode electrode and at least one gate electrode on said first substrate, wherein the cathode electrode and gate electrode are insulated from each other by an insulating layer;

at least one electron emitting region on said cathode electrode, the electron emitting region comprising an electron emitting material;

at least one anode electrode and red, green and blue phosphor layers on said second substrate; and a grid electrode having holes for passing electrons emitted from said electron emitting region, wherein said grid electrode comprises a nickel-iron alloy having a nickel content ranging from about 45 to about 50 wt % and said grid electrode further comprises at least one metal selected from the group consisting of cobalt and titanium.

9. The electron emission device according to claim 8, wherein the nickel content of the grid electrode is from about 47 to about 49 wt %.

* * * * *